United States Patent [19]

Mansson

[11] 4,046,155

[45] Sept. 6, 1977

[54] WASHING APPARATUS FOR A COMPOUND COMPRESSOR

[75] Inventor: Martin Mansson, Finspong, Sweden

[73] Assignee: Stal-Laval Turbin AB, Finspong, Sweden

[21] Appl. No.: 642,110

[22] Filed: Dec. 18, 1975

[30] Foreign Application Priority Data

Dec. 30, 1974 Sweden ..... 7416342

[51] Int. Cl.[2] ..... B08B 3/02; B08B 9/00

[52] U.S. Cl. ..... 134/167 R; 134/169 A

[58] Field of Search ..... 134/22 R, 24, 166 R, 134/166 C, 167 R, 167 C, 168 R, 168 C, 169 A, 172, 179, 198

[56] References Cited

U.S. PATENT DOCUMENTS

| | | | |
|---|---|---|---|
| 3,003,506 | 10/1961 | Wosicki | 134/167 R X |
| 3,813,299 | 5/1974 | Bugor | 134/169 A X |

FOREIGN PATENT DOCUMENTS

| | | | |
|---|---|---|---|
| 103,978 | 6/1899 | Germany | 134/166 R |
| 689,380 | 4/1965 | Italy | 134/169 A |

*Primary Examiner*—Robert L. Bleutge

*Attorney, Agent, or Firm*—Pollock, Vande Sande & Priddy

[57] ABSTRACT

Apparatus for washing the blades of the high-pressure compressor of a two-stage turbo-compressor. A spray tube is mounted radially outwardly of an aperture defined in the turbine casing, but is capable of being moved radially inwardly through the aperture so as to direct an axial stream of wash water into the high-pressure compressor in response to the build-up of water pressure in a supply line which acts upon a piston against the action of a spring. In the absence of water pressure, the spring maintains the spray tube in its normal position externally of the casing.

1 Claim, 2 Drawing Figures

10
1
4
8
11
9
7
5
6
5
6
3
13
2
3
4
7
8
5
6
5
6

18
16
10
15
17
12
14
8
9

WASHING APPARATUS FOR A COMPOUND COMPRESSOR

BACKGROUND OF THE INVENTION

The present invention relates to a washing apparatus for compound compressors comprising a radially directed spray tube which is provided at one end with a spray opening which is directed in the axial direction.

Compressors, such as those which are included in gas turbines, must be washed at certain intervals since air pollution products have a tendency to deposit a coating of dirt on the turbine blades. In industrial environments, it may sometimes be necessary to remove the dirt at intervals of only two or three days. Usually the washing of the compressors is performed by spraying water into the air inlet of the compressor during starting air injection, that is injection of air before starting.

Turbo compressors of the two-stage type comprise a low-pressure compressor, which delivers air through an air channel to a high-pressure compressor driven at a higher speed. In conventional water washing of compound compressors, it has been found that it is difficult to get the high-pressure compressor clean. By the spraying of water into the air inlet, it is easy to remove the dirt cover on the low-pressure compressor, but the removed dirt is then deposited to a large extent on the guide blades and rotor blades of the high-pressure compressor.

SUMMARY OF THE INVENTION

With the means according to the invention, an efficient cleaning of the high-pressure compressor can be achieved. This is accomplished by providing a spray tube which is normally disposed externally of a casing surrounding the compressor and opposite an aperture in said casing. A spring-biased piston responsive to the pressure of the wash water moves the spray tube inwardly through the aperture so that an axially directed stream of water can be dispensed into the compressor.

BRIEF DESCRIPTION OF THE DRAWINGS

The invention is characterized by what has been described in the claims and will be described in the following with reference to the accompanying schematic drawing, in which:

DETAILED DESCRIPTION OF THE PREFERRED EMBODIMENT

Figure 1:
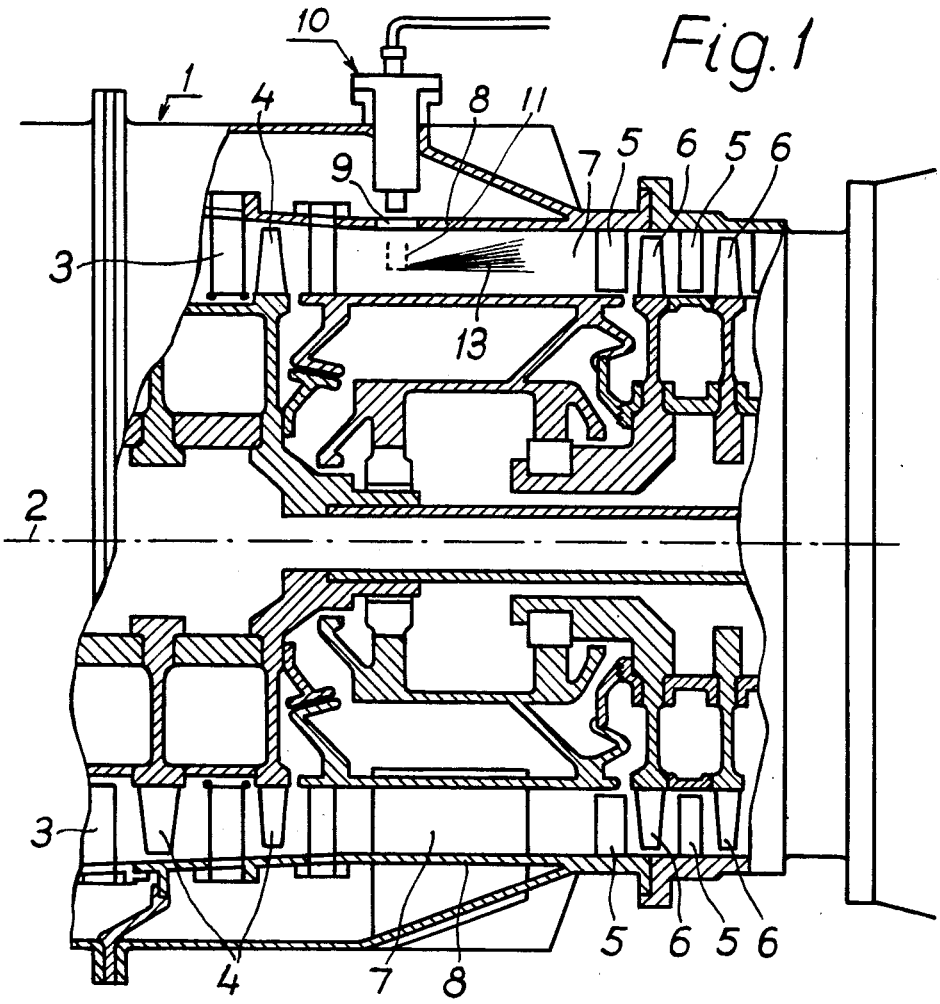
FIG. 1, in a side view as well as an axial view, shows a part of a gas turbine provided with the washing apparatus according to the invention.

In the drawing, numeral 1 designates a gas turbine and 2 the axis of rotation of the gas turbine 1. The gas turbine comprises a blade compressor containing a low-pressure compressor with guide blades 3 and rotor blades 4, and a high-pressure compressor, driven at a higher speed, with guide blades 5 and rotor blades 6.

The exhaust opening of the low-pressure compressor is connected to the air inlet of the high-pressure compressor by means of an annular air channel 7 which is limited radially outwardly by a cylindrical wall or casing 8 with an opening 9.

A washing apparatus 10 according to the invention is flanged to the casing of the gas turbine. The washing apparatus has a spray tube 12 which, during washing, is positioned with its tube end in the position designated 11 and indicated by dashed lines, and which provides a shower 13 of finely dispersed water in axial direction by means of an axially directed nozzle 14. When washing is not in progress, the entire spray tube 12 is located radially outside the aperture 9. Withdrawal of the spray tube 12 takes place automatically simultaneously with the shutting off of the wash water.

Figure 2:
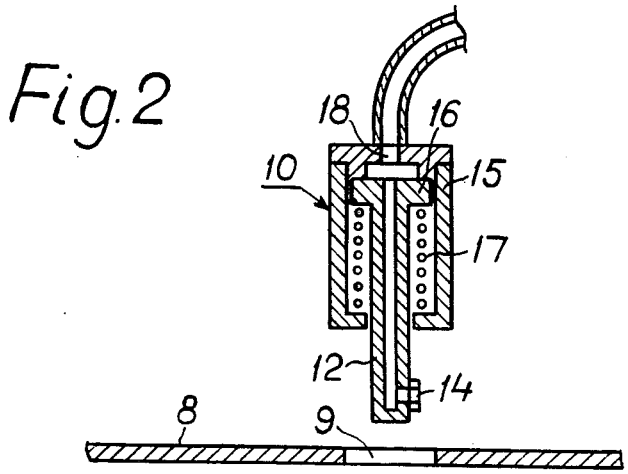
FIG. 2 shows the apparatus of FIG. 1 in axial section through the spray tube.

In FIG. 2, numeral 15 designates a pressure cylinder which surrounds the spray tube 12 and the pertinent piston 16 as well as a spring 17. The nozzle 14 is directed in the cross-direction of the spray tube and thus is directed along the axis of the compressor. Washing water is supplied through an inlet opening 18 and passes through the piston 16 and the spray tube 12, but produces sufficient pressure on the piston 16 to compress the spring 17 so that the spray tube 12 is thus moved radially through the opening 9 and retained there throughout the washing operation.

It will be appreciated by one skilled in the art that the washing apparatus of the invention is much preferred to an arrangement in which a spray tube is used which is positioned permanently with one end inside the air channel 7; with the latter arrangement, there is considerable risk that turbulence will arise in the air channel which may easily have an adverse effect upon operation of the compressor.

What I claim is:

1. Washing apparatus for a compound compressor of the type comprising a generally annular casing, at least one low pressure compressor, at least one high pressure compressor and at least one connecting channel therebetween, comprising:

a spray tube having a fluid inlet through which washing fluid is admitted under pressure at the time of a washing operation;

means for mounting said spray tube on said compound compressor externally of said casing and radially opposite an aperture defined in said casing, said aperture being so positioned along the axial length of said compound compressor that said aperture opens into said at least one connecting channel; and means actuated by washing fluid pressure at said spray tube inlet for moving said spray tube radially inwardly through said aperture, whereby said spray tube is normally positioned externally of said casing but is automatically moved inwardly of said casing through said aperture as washing fluid pressure is applied to said spray tube.

* * * * *